United States Patent [19]

Carwin

[11] Patent Number: 5,074,574

[45] Date of Patent: Dec. 24, 1991

[54] HEADREST SYSTEM FOR WHEELCHAIRS

[76] Inventor: Gene F. Carwin, 15132 County Rd. 19, Fort Morgan, Colo. 80701

[21] Appl. No.: 580,772

[22] Filed: Sep. 11, 1990

[51] Int. Cl.[5] ..... A47C 7/38

[52] U.S. Cl. ..... 280/304.1; 297/397; 297/DIG. 4

[58] Field of Search ..... 280/304.1, 250.1, 907; 297/391, 397, 410, DIG. 4

[56] References Cited

U.S. PATENT DOCUMENTS

| | | | |
|---|---|---|---|
| 3,429,615 | 2/1969 | Belk | 297/410 |
| 3,497,259 | 2/1970 | Sherfey | 297/391 |
| 3,704,850 | 12/1972 | Hendrickson et al. | 403/108 X |
| 4,227,740 | 10/1980 | East | 297/DIG. 4 X |
| 4,431,206 | 2/1984 | Pryor | 280/304.1 |
| 4,592,570 | 6/1986 | Nassiri | 280/250.1 X |
| 4,802,683 | 2/1989 | Gillum, Sr. | 280/304.1 X |
| 4,989,836 | 2/1991 | Hudson, III et al. | 297/DIG. 4 X |

*Primary Examiner*—Charles A. Marmor
*Assistant Examiner*—Victor E. Johnson
*Attorney, Agent, or Firm*—Dean P. Edmundson

[57] ABSTRACT

An adjustable headrest system is described for use on a conventional wheelchair. The system includes upright supports secured or attached to the handles of the wheelchair (and preferably also to the lower portion of the frame of the wheelchair). A headrest cushion is supported by the upright supports. The headrest is flexible and conformable and its position relative to the seating area of the wheelchair is adjustable. The headrest system does not interfere with normal use of the wheelchair.

5 Claims, 3 Drawing Sheets

HEADREST SYSTEM FOR WHEELCHAIRS

FIELD OF THE INVENTION

This invention relates to wheelchairs. More particularly, this invention relates to accessories for wheelchairs. Even more particularly, this invention relates to headrest systems for wheelchairs.

BACKGROUND OF THE INVENTION

Wheelchairs have been in common use for many years and provide the only practical means for supporting and transporting non-ambulatory people from one place to another as an alternative to walking. Although various accessories have been developed to make the seat area of wheelchairs more comfortable, there has not been provided a convenient or effective headrest system for a wheelchair.

People using wheelchairs for several hours at a time often become tired and fatigued because they must support their head and neck areas in an upright position all the time. This is extremely undesirable.

SUMMARY OF THE PRESENT INVENTION

In accordance with the present invention there is provided an adjustable headrest system for a conventional wheelchair. In one embodiment the system comprises:

(a) left and right upright support members secured respectively to the left and right handle members of the wheelchair;

(b) a headrest member supported by the upright support members.

The headrest is flexible and conformable. It is very comfortable for the user and enables him or her to lean rearwardly to support the head and neck areas while sitting in the chair.

The headrest can be adjusted forwardly and rearwardly, as desired. It may also be adjusted vertically. These adjustments are very desirable and enable the headrest position to be adjusted to adapt to any user's desires. Thus, the position of the headrest can be adjusted to meet any requirements of the user, regardless of the size of the user.

The headrest system of this invention does not interfere with the folding or collapsible nature of the conventional wheelchair. Thus, the headrest does not have to be removed from the wheelchair in order for the wheelchair to be folded or collapsed. On the other hand, the headrest can be easily removed from the wheelchair when desired. The headrest of this invention does not interfere with normal use of the wheelchair.

Other advantages of the headrest system of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 2:
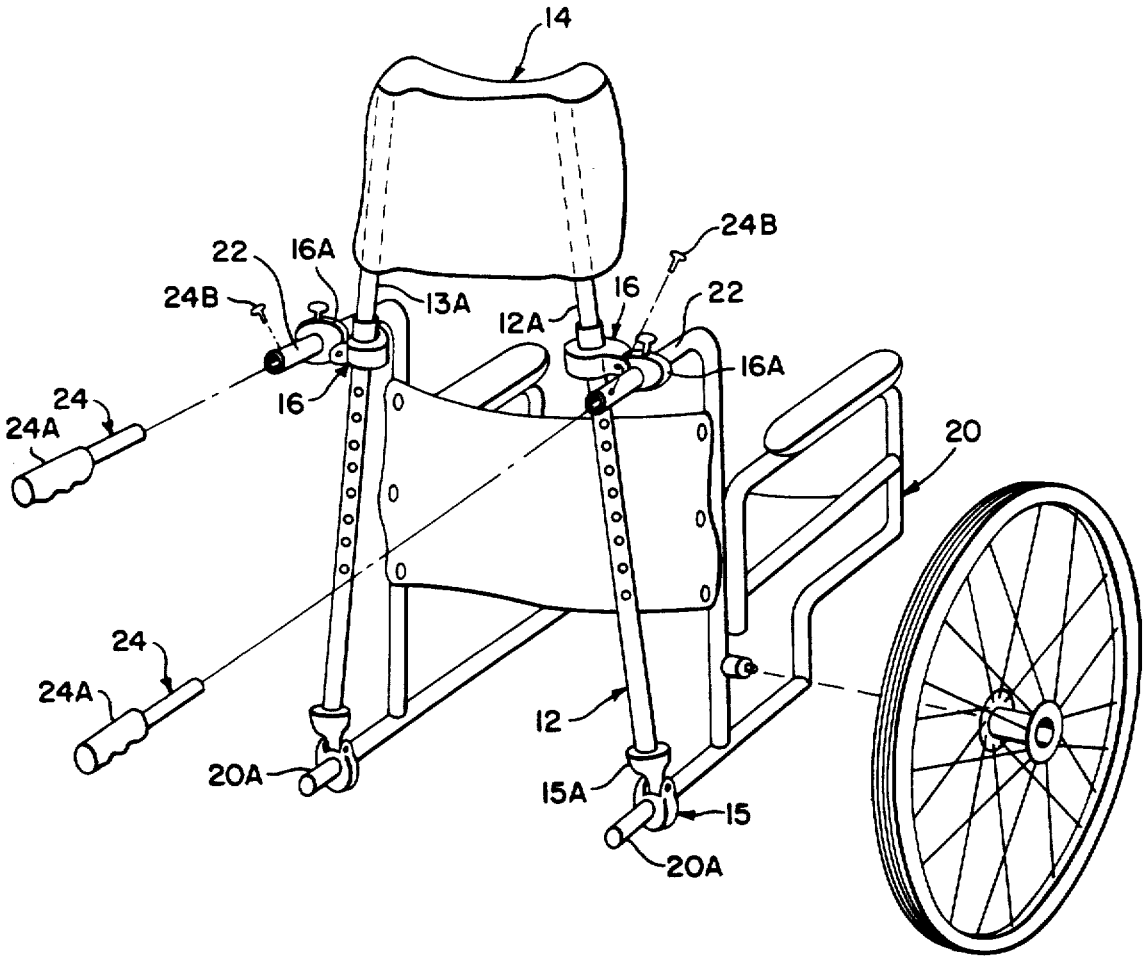
FIG. 2 is a rear perspective view of a conventional wheelchair having attached thereto the headrest system shown in FIG. 1.

In the drawings there is shown a preferred embodiment of an adjustable headrest system 10 of the invention. This headrest system is especially adapted for use on a conventional wheelchair (e.g., as illustrated in FIG. 2). It is also fully adjustable so as to accommodate any size person and it can adapt to any particular desires of the user insofar as positioning of the headrest is concerned.

Figure 1:
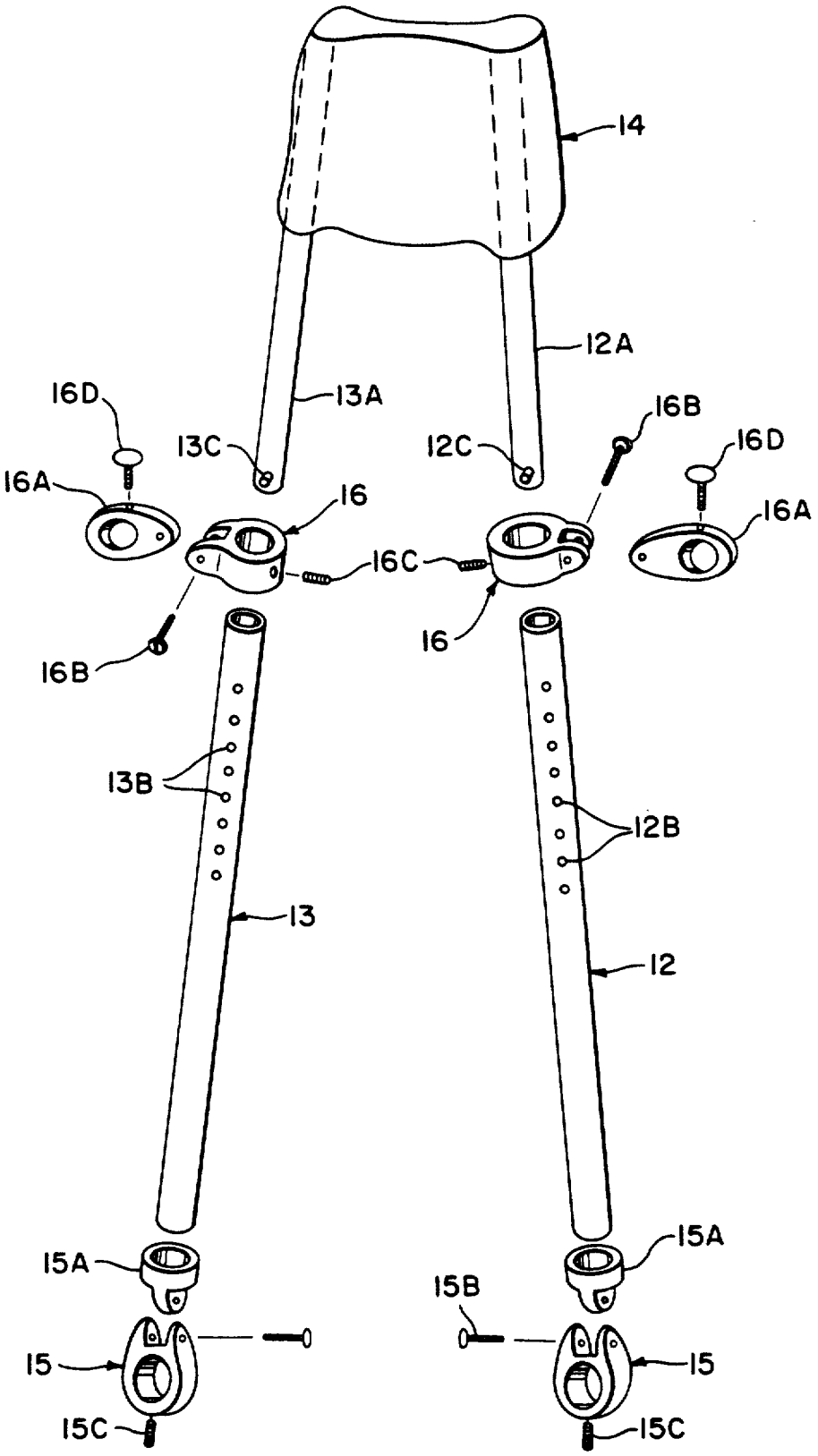
FIG. 1 is an elevational exploded view showing one embodiment of headrest system of the invention.

As shown in FIG. 1, the headrest system 10 includes upright support members 12 and 13 and a headrest cushion member 14. Preferably there are also included telescoping sections 12A and 13A which are adapted to be slidably received in the open tubular members 12 and 13, respectively.

A plurality of spaced apertures 12B and 13B in tubular members 12 and 13 are adapted to be engaged by the biased pin members 12C and 13C carried by the lower end of telescoping section 12A and 13A, respectively. The telescoping sections 12A and 13A can be positioned at any desired height relative to tubular members 12 and 13 and the seating area of the wheelchair.

Clamps 15 and 16 are adapted to secure the lower and upper ends, respectively, of support member 12 to the conventional wheelchair in the manner shown in FIG. 2. The same type of clamps are adapted to secure the lower and upper ends of support member 13 to the wheelchair in similar fashion.

Adaptor or bracket 15A fastens to the lower end of each support member and is pivotably connected to clamp 15 by means of a threaded screw or pin 15B. Clamp 15 is adapted to slide onto frame extension member 20A of the wheelchair frame 20 and can be fixed or locked at the desired position by means of set screw 15C.

Clamp 16 slides over the upper end of support member 12 and can be fixed in position by means of set screw 16C. Another clamp 16A is adapted to slide over handle member 22 of the wheelchair and can be fixed or locked in a desired position by means of thumb screw 16D or equivalent fastening means. Threaded screw or pin 16B connects clamp 16 to clamp 16A, as illustrated.

The same type of clamps are used to secure upright support member 13 to the left side frame extension 20A and left handle member 22.

Handle extension members 24 are adapted to slide over the handle members 22 of the chair and are secured in place by means of threaded screws 24B. Grips 24A are positioned over the handle extensions.

Headrest cushion 14 preferably includes vertical passageways on the rearward face to enable the cushion to slide onto the upper ends of telescoping sections 12A and 13A. The headrest cushion can be easily removed, if desired.

The cushion 14 preferably comprises a compressible resilient foam core covered by durable and flexible plastic or fabric material. It is also preferable for the front face of the cushion to be slightly concave or otherwise contoured to more comfortably receive the rear of the head of the user. Although the headrest cushion can be provided in any desired size, convenient dimensions for most people are a height of about 10 inches, a thickness of 2-3 inches, and a length of about 12-13 inches. The length may be slightly longer at the base of the cushion than at the top. Other sizes are also possible, of course.

If it is desirable or necessary to remove the headrest cushion, the telescoping members 12A and 13A can then be pushed down completely into the respective upright supports 12 and 13. Sometimes this is done when transporting the wheelchair in a car or other vehicle and it is necessary to make the chair as small as possible.

The headrest member can be positioned at any desired height and also at any desired forward or rearward position relative to the seating area of the wheelchair. For example, by loosening upper clamps 16 and lower clamps 15, the headrest member 14 can be caused to move either forwardly or rearwardly, as desired.

Figure 3:
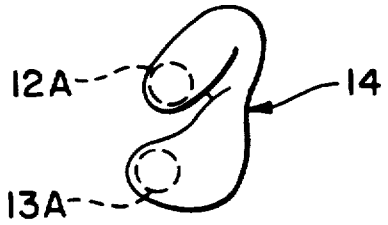
FIG. 3 is a top view of the headrest member in folded position when the wheelchair is in its collapsed position.

The headrest system of this invention can be fastened to any conventional wheelchair for use, as desired. It does not interfere with the normal use of the wheelchair. Also, the headrest system does not interfere with the collapsing feature of wheelchairs in which the two sides of the chair are drawn close together. The headrest cushion 14 is adapted to fold when the wheelchair is collapsed (as shown in FIG. 3). Thus, the headrest portion does not interfere with the normal collapsing feature of a wheelchair.

Figure 4:
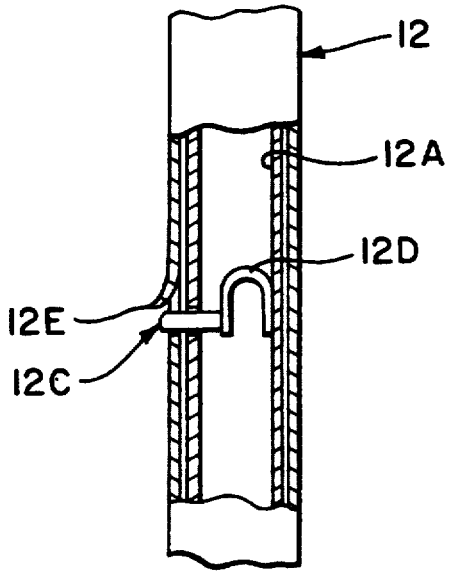
FIG. 4 is a partial cut-away view of a preferred embodiment of telescoping support member which is very useful in headrest systems of this invention.

FIG. 4 illustrates a preferred type of catch means in this invention in the connection of the telescoping section to the upright support. As illustrated, a telescoping section 12A slides into the interior of the tubular upright support 12. Pin member 12C is carried by section 12A and is biased outwardly by means of a spring 12D. Pin 12C extends through an aperture in support member 12 whenever it is aligned with the aperture. In order to release the catch means, the pin can be simply pushed inwardly until it is out of the aperture in the upright support.

In the preferred embodiment shown in FIG. 4, the wall portion 12E adjacent the top edge of each aperture is flared outwardly so that the telescoping section 12A can be raised (i.e., moved upwardly) without previously depressing the pin 12C. Rather, as the section 12A is raised, the outer end of pin 12C engages the tapered wall section and is forced or urged inwardly so as to be displaced from the aperture. On the other hand, the pin 12C does prevent downward movement of the section 12A (unless pin 12C is depressed to clear it out of the aperture).

The headrest system of this invention can be supplied in kit form, if desired, and it can be attached to any conventional wheelchair. It may also be included on wheelchairs in original manufacture, if desired.

The headrest is extremely durable and provides very good support to the head and neck areas of the person using the wheelchair. Its position can be adjustable very easily, as needed. Also, the headrest system does not interfere with normal use of the wheelchair and does not require modification of the wheelchair to allow its use.

Other variants are possible without departing from the scope of this invention. For example, the type of material used for the upright support members may vary, the dimensions may vary, and the types of fastenings used may also vary, as desired.

What is claimed is:

1. An adjustable headrest system for a wheelchair of the type including rearwardly extending left and right handle members and left and right frame extension members below said handle members, said system comprising:

(a) left and right upright support members secured respectively to said left and right handle members; wherein said upright support members comprise telescoping sections; wherein said telescoping sections include releasable catch means for adjusting the height of each said support member; wherein each upright support member includes (i) a lower end adapted to be secured to a respective one of said frame extension members, and (ii) an upper end which is adapted to be secured to a respective one of said handle members; wherein said lower end of each said upright member is attached to a respective one of said frame extension members by means of a first clamp which is selectively movable forwardly and rearwardly along said frame extension member, and wherein said upper end of each said upright member is attached to a respective one of said handle members by means of a second clamp which is selectively movable forwardly and rearwardly along said handle member;

(b) a headrest member supported by said upright support members, wherein said headrest member is flexible and conformable;

wherein the position at which said upright support members are attached to said handle members and to said frame extension members is adjustable.

2. A headrest system in accordance with claim 1, wherein said headrest member is detachable from said upright support members.

3. An improved wheelchair comprising a frame, a bearing support surface, rearwardly extending left and right handle members, rearwardly extending left and right frame extension members carried by said frame and being disposed below said handle members, and a headrest system comprising:

(a) left and right upright support members secured respectively to said left and right handle members; wherein said upright support members comprise telescoping sections each including releasable catch means for adjusting the height of each said support member; wherein each upright support member includes (i) a lower end adapted to be secured to a respective one of said frame extension members, and (ii) an upper end which is adapted to be secured to a respective one of said handle members selectively movable forwardly and rearwardly along said respective handle member;

(b) a headrest member supported by said upright support members, wherein said headrest member is flexible and conformable; wherein said headrest member is detachable from said upright support members;

wherein the position at which said upright support members are attached to said handle members and to said frame extension members is adjustable.

4. An improved wheelchair in accordance with claim 3, wherein each said support member comprises an elongated tubular member which slidably receives one of said telescoping sections; wherein said catch means comprises a plurality of spaced apertures in said tubular member and an outwardly biased pin member carried by said telescoping section; wherein said pin member is adapted to project through one of said apertures when it is in alignment therewith.

5. In a wheelchair of the type including a frame having rearwardly extending left and right frame extension members, a seating support surface, and rearwardly extending left and right handle members, the improvement comprising:

left and right upright support members secured respectively to said left and right handle members; wherein each said upright support member includes an elongated tubular member having spaced apart apertures therein, wherein a telescoping upright section is slidably received in said tubular member, and further comprising an outwardly biased pin member carried by said telescoping upright section for engaging one of said apertures, wherein the longitudinal position of said telescoping upright section relative to said tubular member is adjustable; wherein each upright support member includes (i) a lower end adapted to be secured to a respective one of said frame extension members, and (ii) an upper end which is adapted to be secured to a respective one of said handle members selectively movable forwardly and rearwardly along said respective handle member; and wherein said headrest member is detachable from said upright support members;

(b) a headrest member supported by said upright support members, wherein said headrest member is flexible and conformable; and (c) left and right handle extension members secured respectively to said left and right handle members; wherein the position at which said upright support members are attached to said handle members and to said frame extension members is adjustable.

* * * * *